United States Patent [19]

Gramstrup

[11] 4,056,266

[45] Nov. 1, 1977

[54] ADJUSTABLE BILLIARD TABLE RAIL CONSTRUCTION

[76] Inventor: Torben W. Gramstrup, 1946 W. 130th St., Gardena, Calif. 90249

[21] Appl. No.: 644,301

[22] Filed: Dec. 24, 1975

[51] Int. Cl.[2] ..... A63D 15/00

[52] U.S. Cl. ..... 273/9

[58] Field of Search ..... 273/4 B, 4 R, 5 R, 5 A, 273/8, 3 R, 3 C, 6, 7, 2, 9

[56] References Cited

U.S. PATENT DOCUMENTS

| | | | |
|---|---|---|---|
| 511,571 | 12/1893 | Wiggins | 273/8 |
| 655,503 | 8/1900 | Moffett | 273/9 |
| 1,036,238 | 8/1912 | Hjort | 273/8 |
| 1,158,793 | 11/1915 | Drouot | 273/8 |
| 1,269,614 | 6/1918 | Lapp | 273/8 |

FOREIGN PATENT DOCUMENTS

| | | | |
|---|---|---|---|
| 47,150 | 10/1936 | France | 273/6 |

*Primary Examiner*—Richard C. Pinkham
*Assistant Examiner*—T. Brown

[57] ABSTRACT

A game table wherein the cushion rails are replaceable and held in operating position with right angular corner engagement by means of hidden hold-down fasteners adjustably removable through the slate and overlying cover. The cushion rail is provided with a downwardly facing undercut groove while the upper surface of the rail is imperforate. The marginal portion of the table surface is provided with a plurality of spaced, vertically extending apertures. The head portion of a plurality of bolts is placed within the grooves such that the bolts will not be disengaged from the rail when the bolts are moved in a perpendicular direction away from the rail; the bolts are then inserted into the apertures in the table surface and thereafter, threaded nuts are placed on the lower end of the bolts for tightly securing the rail to the table surface.

7 Claims, 2 Drawing Figures

ADJUSTABLE BILLIARD TABLE RAIL CONSTRUCTION

BACKGROUND

Tables used for the games of billiards and pool are made with extreme accuracy, they are leveled as well as being square, and they are characterized by cushioned rails which are accurately formed and must so be maintained. It is the removability of these rails with which the present invention is concerned and which are most often installed more or less permanently at the perimeter of the table and onto which the cushion is secured and covered with felt or the like. It is the rail that presents a resilient curb from which the game balls rebound, and like the table top or slate per se the said cushions are covered with felted fabric. Needless to say, it is necessary to re-cover the slate and/or to replace and repair the said cushions from time to time and said repair is usually a difficult task with ordinary table construction, involving the removal of through bolts and cover plates, said bolts passing through aligned holes in the slate or frame of the table. Alignment is one major problem and appearance another. Therefore, it is a general object of this invention to provide for the replaceability of the rails in a game table of the type under consideration and primarily for serviceability when replacing the cushions and the felt covers.

Billiard and pool tables involve perimeter rails which join at right angular corners and which are interrupted by pockets in the case of pool tables. That is, the rails are mitered at each corner of the table and are usually fastened to the table without facility for removal; that is, the rails are usually positioned by tightly fitted hold-down bolts passed through the fastened members and hidden from view by removable cover plates. Therefore, it is an object of this invention to improve upon the installation and removability of such rails and to provide a formation thereof suitable to this end. It is also an object of this invention to provide hidden fasteners for removable installation of said rails, the exposed top and side surfaces of the rails, the visible surfaces thereof, remaining undisturbed and without openings, while the hold-down fasteners employed to position the replaceable rails enter only from beneath the rails.

It is an object of this invention to provide a game table rail construction of the type hereinabove referred to and which advantageously employs the slate for support of the rails adapted to be accurately positioned thereon. With the present invention, adequate oversized openings in the slate, which cannot be too accurate in placement, are compensated for by the universal positioning of the hold-down bolts therethrough.

It is another object of this invention to provide a game table rail that lends itself to accurate mass production methods, being adapted to milling and routing methods of wood working, or the like.

SUMMARY OF INVENTION

The rail described and shown herein is adapted to a pool table which involves, generally, a frame F with legs having leveling means (not shown). The frame is a rigid structure adapted to carry a slate top in a flat horizontal plane for the perimeter support of cushioned rails R. It is the cushioned rails R with which this invention is primarily concerned, and specifically the installability and replaceability thereof. Although not shown, it is to be understood that the table when a pool table, includes all the necessary pockets and ball runs. Also not shown are the corner connections of the rails, it being understood that the rails are connected with or without corner pockets, and in the usual manner.

DRAWINGS

The various objects and features of this invention will be fully understood from the following detailed description of the typical preferred form and application thereof, throughout which description reference is made to the accompanying drawings, in which.

PREFERRED EMBODIMENT

Figure 1:
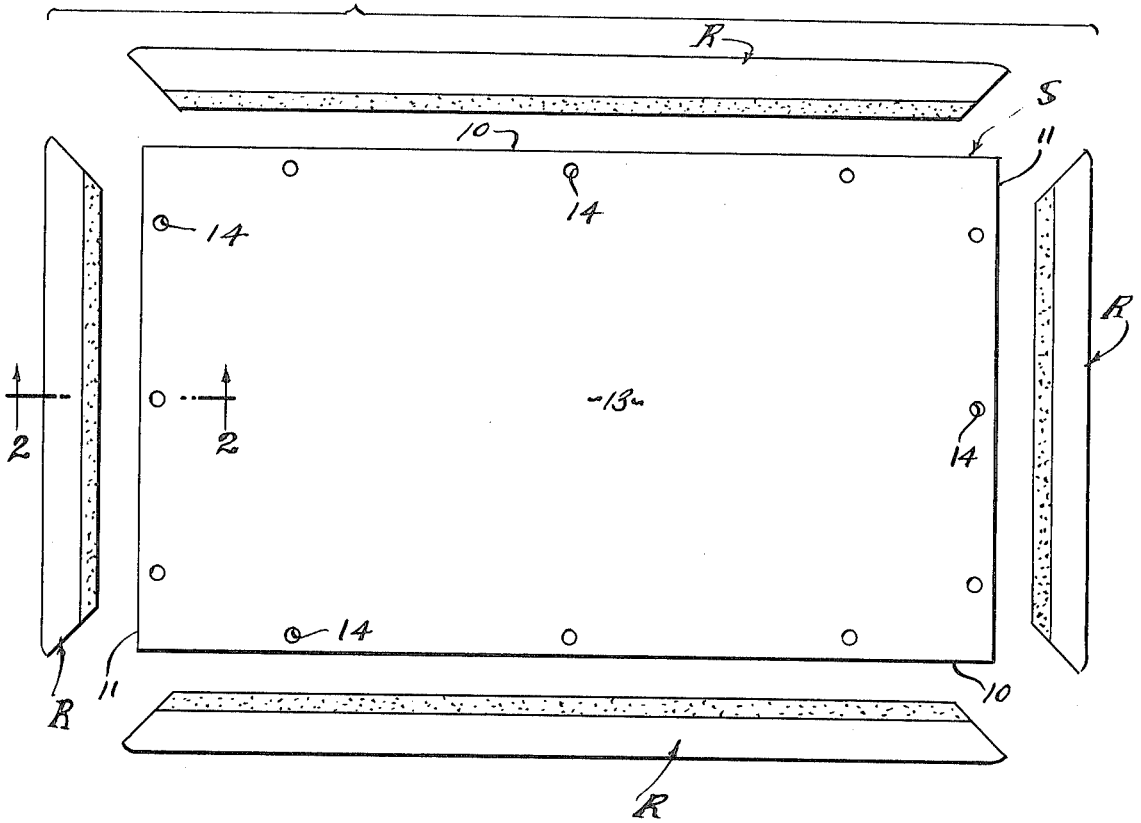
FIG. 1 is an exploded plan view of a game table embodying the features of the present invention and showing the rails removed from the slate.
Figure 2:
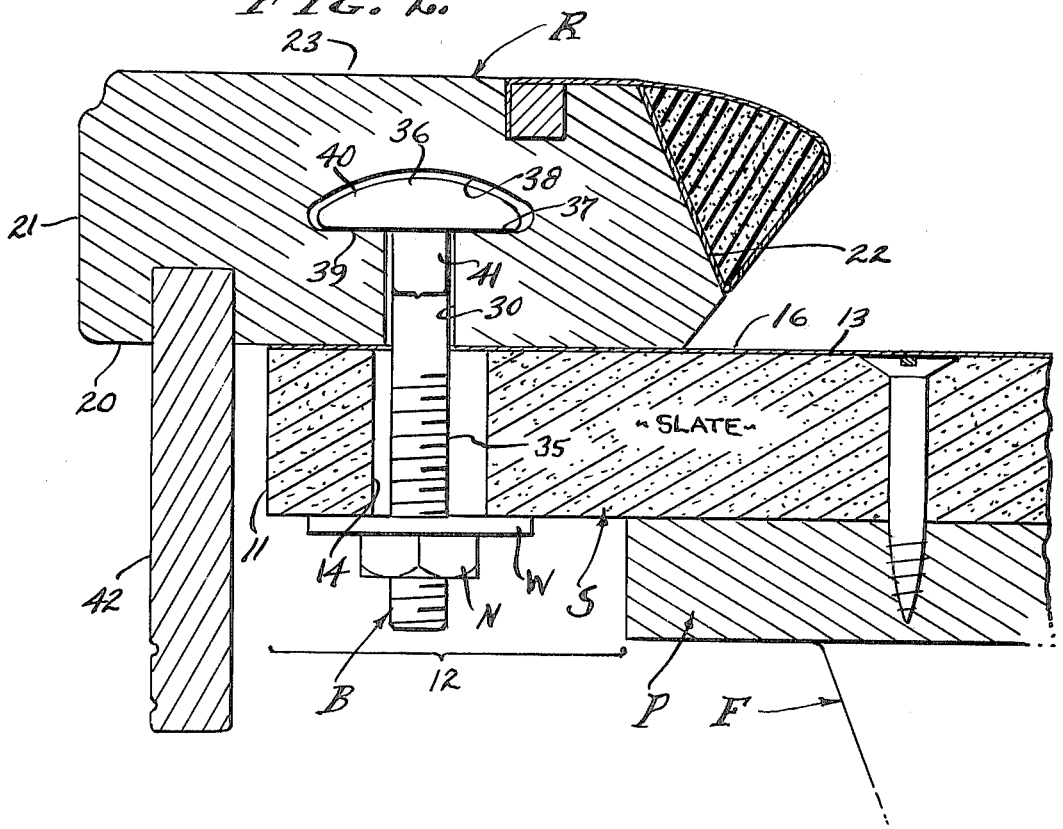
FIG. 2 is an enlarged detailed sectional view of one of the plurality of universal rail connections, taken as indicated by line 2—2 on FIG. 1.

Referring now to the drawings, the game table involves a polygonal and preferably rectangular platform P having pairs of opposite parallel sides and ends 10 and 11 and over which there extends a coextensive surface member or slate S upon which there is a cover 13 of felted fabric or the like. The surface slate S rests upon the platform P and cantilevers therefrom as clearly shown in FIG. 2 of the drawings, being of equal thickness throughout its area of extent. Alternately, the platform P can underlie the slate S coextensively, but in practice it is preferred that a marginal portion 12 of the slate project from the sides and ends 10 and 11 of the platform, respectively.

In accordance with this invention, the marginal portion 12 is punctuated by spaced openings 14 for the passage of through bolts B therethrough, namely the hold-down bolts which characterize this invention. As shown, the openings 14 are substantially larger in diameter than said bolts B, for example twice the diameter. In practice, the slate S is three-quarters to one inch in thickness and the overhanging marginal portion 12 is two to three inches in width, there being several openings along each margin and disposed approximately midway between the side-ends 10-11 and edge 15 of the slate S.

The rails R are sectional members as they extend between the corners of the slate S and between which they are individually coextensive. The rail sections R of the sides and ends of the table are of identical elongated uniform cross section having a flat bottom 20 supported against the upper surface 16 of the slate and its cover and having parallel angularly related inner and outer faces 21 and 22. In accordance with this invention, the top 23 of the rail sections is uninterrupted as it extends between the faces 21 and 22, while the inner face 21 which carries the cushion C is pitched inwardly and downwardly as shown. The angle of the pitched face 21 and cross sectional configuration of the cushion C are conventional substantially as shown.

In accordance with this invention a deep groove or channel 30 is milled to extend longitudinally to the mid section of each rail R and coextensively of the rail length at the underside thereof to align nominally with the openings 14 in the channel 30. The channel 30 is of a width to slideably pass the diameter of the hold-down bolt B, and to the end that the said bolt is free to slide along said channel. It will be seen that the rail R thus far described and including the channel therein, is conducive to being manufactured by the process of milling.

Referring now to the installation of the hidden hold-down bolts B, each of said bolts is characterized by a threaded shank 35 and a head 36, and in accordance with this invention it is the head 36 that is held by anchored means within the rail R. To this end therefore, the bottom of the channel 30 is enlarged coextensively and laterally thereof so as to pass the head 36, presenting a seat 37 faced upwardly to receive the bottom face of said bolt head. It will be seen that the lateral enlargement of the channel 30 is conducive to the process of routing, and in practice the enlargement 38 formed thereby conforms to the head configuration of the bolt with suitable clearances for slideability of the bolt head 36 therethrough. As shown, a carriage bolt or step bolt is employed, with a head having a flat bottom face 39 for seated engagement, a convex top 40 and a secured upper shank 41 underlying the head. The shank 35 or bolt length is such as to pass through the slate opening 14 and depend from the slate S to receive a washer W secured by a nut N. The washer W is substantially larger in diameter than the opening 14 and such as to overlie the opening diameter in all instances as and when the bolt is eccentrically positioned relative to said opening.

From the foregoing it will be seen that the top 23 of the rail is virtually uninterrupted, and that said top surface thereof is not encombered in any way. It will also be observed that the rail R is directly installed onto the slate S and its cover 13, with a facer 42 depending from the rail to surround the slate. Assembly of the rails is accomplished by sliding the required number of hold-down bolts B into the channels 30 with the heads 36 thereof captured within the enlargements 38. As clearly illustrated in FIG. 2, any irregularity in the placement or size of the openings 14, within a tolerance, is compensated for in the smaller size or diameter of said bolt shanks 35, and to this end each rail R is shiftable into its optimum required position, without restriction, where it is fastened down by tightening of the said hold-down bolts B by the application of said clamp washer W and nuts N thereto.

Having described only a typical preferred form and application of my invention, I do not wish to be limited or restricted to the specific details herein set forth, but wish to reserve to myself any modifications or variations that may appear to those skilled in the art:

I claim:

1. A hidden hold-down and replaceable adjustable rail construction for billiard tables and the like, and including; a platform with an overlying surface member having a marginal portion with openings therethrough, at least one replaceable rail shiftably engageable over said marginal portion and comprising an elongated member having an imperforate top and a flat bottom seated upon the surface member and with a channel longitudinally coextensive with and entering the bottom and having a lateral enlargement defining an upwardly faced seat longitudinally coextensive therewith, and hold-down bolts and each with a first member slideable into the channel to engage downwardly upon said seat and one bolt for positioned alignment within each of said openings in the surface member to extend through and project downwardly from the surface member, said bolts having shanks substantially smaller in diameter than the size of any of said openings through said surface member for selective placement of the rail, there being a second member operable by each of the bolts to engage upwardly beneath said surface member to hold said placement of the rail.

2. The hidden hold-down and replaceable adjustable rail construction for tables as set forth in claim 1, wherein the marginal portion of the surface member cantilevers from the platform exposing the opening therethrough independent from said platform.

3. The hidden hold-down and replaceable adjustable rail construction for tables as set forth in claim 1, wherein the surface member is made of slate.

4. The hidden hold-down and replaceable adjustable rail construction for tables as set forth in claim 1, wherein the surface member is made of slate with the marginal portion thereof cantilevered from the platform exposing the opening therethrough independent from said platform.

5. The hidden hold-down and replaceable adjustable rail construction for tables as set forth in claim 1, wherein the said first member carried by each of the bolts is in the form of a head engaged downwardly upon an upwardly faced seat defined by said enlargement.

6. The hidden hold-down and replaceable adjustable rail construction for tables as set forth in claim 1, wherein the said second member operable by each of the bolts is a nut threaded thereon to engage upwardly beneath the said surface member.

7. The hidden hold-down and replaceable adjustable rail construction for tables as set forth in claim 1, wherein the said first member carried by each of the bolts is in the form of a head engaged downwardly upon an upwardly faced seat defined by said enlargement, and wherein the said second member operable by each of the bolts is a nut threaded thereon to engage upwardly beneath the said surface member.

* * * * *